US009514868B2

(12) United States Patent
Omura et al.

(10) Patent No.: US 9,514,868 B2
(45) Date of Patent: Dec. 6, 2016

(54) GRAIN ORIENTED ELECTRICAL STEEL SHEET AND METHOD FOR MANUFACTURING THE SAME

(75) Inventors: Takeshi Omura, Tokyo (JP); Hiroi Yamaguchi, Tokyo (JP); Seiji Okabe, Tokyo (JP)

(73) Assignee: JFE Steel Corporation (JP)

( * ) Notice: Subject to any disclaimer, the term of this patent is extended or adjusted under 35 U.S.C. 154(b) by 274 days.

(21) Appl. No.: 13/805,773

(22) PCT Filed: Jun. 28, 2011

(86) PCT No.: PCT/JP2011/003684

§ 371 (c)(1),
(2), (4) Date: Jan. 2, 2013

(87) PCT Pub. No.: WO2012/001952

PCT Pub. Date: Jan. 5, 2012

(65) Prior Publication Data

US 2013/0098507 A1 Apr. 25, 2013

(30) Foreign Application Priority Data

Jun. 29, 2010 (JP) ..... 2010-148322
Aug. 5, 2010 (JP) ..... 2010-176102

(51) Int. Cl.

| | |
|---|---|
| ***H01F 1/01*** | (2006.01) |
| ***C21D 9/46*** | (2006.01) |
| ***C21D 10/00*** | (2006.01) |
| ***C22C 38/00*** | (2006.01) |
| ***C22C 38/04*** | (2006.01) |
| ***C22C 38/06*** | (2006.01) |
| ***H01F 41/06*** | (2016.01) |
| ***H01F 1/18*** | (2006.01) |
| ***C22C 38/02*** | (2006.01) |
| ***C22C 38/08*** | (2006.01) |
| *C21D 8/12* | (2006.01) |

(52) U.S. Cl.

CPC ..... *H01F 1/01* (2013.01); *C21D 8/1283* (2013.01); *C21D 8/1288* (2013.01); *C21D 8/1294* (2013.01); *C21D 9/46* (2013.01); *C21D 10/005* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *H01F 1/18* (2013.01); *H01F 41/0604* (2013.01); *C21D 8/1222* (2013.01); *C21D 2201/05* (2013.01)

(58) Field of Classification Search

CPC ... C21D 8/12; C21D 10/005; C21D 2201/05
USPC ..... 148/100, 111, 307
See application file for complete search history.

(56) References Cited

U.S. PATENT DOCUMENTS

| | | | | |
|---|---|---|---|---|
| 5,145,533 | A * | 9/1992 | Yoshitomi et al. | 148/111 |
| 6,666,929 | B1 * | 12/2003 | Ban | 148/111 |
| 2002/0000261 | A1 * | 1/2002 | Fujikura et al. | 148/121 |
| 2003/0102055 | A1 * | 6/2003 | Fujikura et al. | 148/307 |

FOREIGN PATENT DOCUMENTS

| | | | | |
|---|---|---|---|---|
| JP | 57-2252 | | 1/1982 | |
| JP | 61-69921 | A | 4/1986 | |
| JP | 6-72266 | B | 9/1994 | |
| JP | 10-204533 | | 8/1998 | |
| JP | 11-279645 | A | 10/1999 | |
| JP | 2000-323318 | A | 11/2000 | |
| JP | 2001-303137 | A | 10/2001 | |
| JP | 2001-303261 | A | 10/2001 | |
| JP | 2001303261 | A * | 10/2001 | C23C 22/00 |
| JP | 2002-2356750 | | 12/2002 | |
| JP | 2003-166018 | A | 6/2003 | |
| JP | 2006-117964 | A | 5/2006 | |

OTHER PUBLICATIONS

English Translation of JP2001303261, Jan. 7, 2015.*
English translation of Notification of Reasons for Refusal dispatched Aug. 19, 2014 from corresponding Japanese Patent Application No. 2010-176102.
Mexican Office Action dated May 27, 2015 of corresponding Mexican Application No. Mx/a/2012/014882 along with its English translation.

* cited by examiner

*Primary Examiner* — Jie Yang
(74) *Attorney, Agent, or Firm* — DLA Piper LLP (US)

(57) ABSTRACT

A grain oriented electrical steel sheet is subjected to magnetic domain refinement by laser irradiation or electron irradiation and exhibits excellent low noise properties and low iron-loss properties when assembled into a real transformer device, by setting: the total tension (A) in rolling direction imparted to the steel sheet by the forsterite coating and the tension coating to be equal to or higher than 10.0 MPa; setting the total tension (B) in a direction orthogonal to the rolling direction imparted to the steel sheet by the forsterite coating and the tension coating to be equal to or higher than 5.0 MPa; and setting the total tension (A) and the total tension (B) to satisfy a formula shown below.

$1.0 \leq A/B \leq 5.0$

5 Claims, No Drawings

GRAIN ORIENTED ELECTRICAL STEEL SHEET AND METHOD FOR MANUFACTURING THE SAME

RELATED APPLICATIONS

This is a §371 of International Application No. PCT/JP2011/003684, with an international filing date of Jun. 28, 2011 (WO 2012/001952 A1, published Jan. 5, 2012), which is based on Japanese Patent Application No. 2010-148322, filed Jun. 29, 2010, and Japanese Patent Application No. 2010-176102, filed Aug. 5, 2010, the subject matter of which is incorporated herein by reference.

TECHNICAL FIELD

This disclosure relates to a grain oriented electrical steel sheet for use in an iron core material of a transformer or the like and a method for manufacturing the grain oriented electrical steel sheet.

BACKGROUND

A grain oriented electrical steel sheet is mainly utilized as an iron core of a transformer and required to exhibit superior magnetization characteristics, e.g. low iron loss in particular.

In this regard, it is important to highly align or accumulate secondary recrystallized grains of a steel sheet in (110)[001] orientation, i.e. what is called "Goss orientation", and reduce impurities in a product steel sheet. However, there are restrictions on controlling crystal grains and reducing impurities in view of production cost. Accordingly, there has been developed a technique of introducing non-uniformity into a surface of a steel sheet by physical means to subdivide the width of a magnetic domain to reduce iron loss, i.e. magnetic domain refinement technique.

For example, JP-B 57-002252 proposes a technique of irradiating a steel sheet as a finished product with a laser to introduce high-dislocation density regions into a surface layer of the steel sheet, thereby narrowing magnetic domain widths and reducing iron loss of the steel sheet. The magnetic domain refinement technique using laser irradiation was improved thereafter (see JP-A 2006-117964, JP-A 10-204533, JP-A 11-279645 and the like), so that a grain oriented electrical steel sheet having good iron loss properties can be obtained.

Further, JP-B 06-072266 proposes a technique of controlling magnetic domain widths by irradiation of electron beam.

However, there is a problem in that, when such various types of grain oriented electrical steel sheets as described above subjected to magnetic domain refinement of irradiating the steel sheets with a laser or an electron beam are each assembled into real transformer devices, these transformers make louder noises than grain oriented electrical steel sheets not subjected to magnetic domain refinement. Further, there arises another problem in that iron loss of a real transformer device hardly improves after all, although iron loss of a grain oriented electrical steel sheet as an iron core material has been reduced by magnetic domain refinement through irradiation by laser or electron beam, i.e. a problem of extremely poor "building factor" (BF).

It could therefore be helpful to provide a grain oriented electrical steel sheet which, when assembled into a real transformer device, exhibits excellent low-noise properties and low-iron loss properties, and an advantageous method for manufacturing the grain oriented electrical steel sheet.

SUMMARY

We thus provide:

[1] A grain oriented electrical steel sheet having forsterite coating and tension coating on a surface thereof and having subjected to magnetic domain refinement by laser irradiation, wherein: the total tension in rolling direction, imparted to the steel sheet by the forsterite coating and the tension coating, is equal to or higher than 10.0 MPa and the total tension in a direction orthogonal to the rolling direction, imparted to the steel sheet by the forsterite coating and the tension coating, is equal to or higher than 5.0 MPa; and the total tension in the rolling direction and the total tension in the direction orthogonal to the rolling direction satisfy a formula shown below.

$$1.0 \leq A/B \leq 5.0$$

A: the total tension in rolling direction, imparted to the steel sheet by forsterite coating and tension coating B: the total tension in a direction orthogonal to the rolling direction, imparted to the steel sheet by forsterite coating and tension coating

[2] A grain oriented electrical steel sheet having forsterite coating and tension coating on a surface thereof and having subjected to magnetic domain refinement by electron beam irradiation, wherein: the total tension in rolling direction, imparted to the steel sheet by the forsterite coating and the tension coating, is equal to or higher than 10.0 MPa and the total tension in a direction orthogonal to the rolling direction, imparted to the steel sheet by the forsterite coating and the tension coating, is equal to or higher than 5.0 MPa; and the total tension in the rolling direction and the total tension in the direction orthogonal to the rolling direction satisfy a formula shown below.

$$1.0 \leq A/B \leq 5.0$$

A: the total tension in rolling direction, imparted to the steel sheet by forsterite coating and tension coating B: the total tension in a direction orthogonal to the rolling direction, imparted to the steel sheet by forsterite coating and tension coating

[3] A method for manufacturing a grain oriented electrical steel sheet, comprising: rolling a slab for a grain oriented electrical steel sheet to obtain a steel sheet having final sheet thickness; subjecting the steel sheet to decarburizing annealing; then coating a surface of the steel sheet with annealing separator mainly composed of MgO; subjecting the steel sheet thus coated to final annealing; providing tension coating to the steel sheet; and subjecting the steel sheet to magnetic domain refinement by laser irradiation after either the final annealing or provision of the tension coating, wherein the method further comprises: (1) setting coating weight of the anneal separator to be at least 10.0 g/m$^2$; (2) setting coiling tension at which the steel sheet is coiled after being coated with the annealing separator to be in the range of 30 N/mm$^2$ to 150 N/mm$^2$; and (3) controllably setting the average cooling rate in cooling process of the final annealing down to 700° C. to be 50° C./hour or less.

[4] A method for manufacturing a grain oriented electrical steel sheet, comprising: rolling a slab for a grain oriented electrical steel sheet to obtain a steel sheet having final sheet thickness; subjecting the steel sheet to decarburizing annealing; then coating a surface of the steel sheet with annealing separator mainly composed of MgO; subjecting the steel sheet thus coated to final annealing; providing tension coating to the steel sheet; and subjecting the steel sheet to magnetic domain refinement by electron beam irradiation after either the final annealing or provision of the tension coating, wherein the method further comprises: (1) setting coating weight of the anneal separator to be at least 10.0 $g/m^2$; (2) setting coiling tension at which the steel sheet is coiled after being coated with the annealing separator to be in the range of 30 $N/mm^2$ to 150 $N/mm^2$; and (3) controllably setting the average cooling rate in cooling process of the final annealing down to 700° C. to be 50° C./hour or less.

[5] The method for manufacturing a grain oriented electrical steel sheet of [3] or [4] above, further comprising subjecting the slab for a grain oriented electrical steel sheet to the hot rolling, optionally hot-band annealing, and either one cold rolling operation or at least two cold rolling operations with intermediate annealing therebetween to obtain a steel sheet having the final sheet thickness.

It is possible to effectively maintain an excellent effect of reducing iron loss through magnetic domain refinement using a laser/electron beam demonstrated by a steel sheet in a resulting real transformer device as well, whereby a grain oriented electrical steel sheet exhibiting, when assembled into a real transformer device, excellent low-noise properties and low-iron loss properties can be obtained.

DETAILED DESCRIPTION

Our steel sheets and methods will be described in detail hereinafter.

Tension imparted to a grain oriented electrical steel sheet having a forsterite coating (a coating mainly composed of $Mg_2SiO_4$) and having been subjected to magnetic domain refinement by laser or electron beam irradiation is specifically controlled to prevent in a real transformer device using the grain oriented electrical steel sheet noise made by the real transformer device from increasing and the "building factor" from deteriorating.

When a grain oriented electrical steel sheet having a forsterite coating is subjected to magnetic domain refinement by laser irradiation or electron beam irradiation, magnetostrictive properties of the steel sheet tend to deteriorate because the forsterite coating is damaged by thermal strain caused by the laser/electron beam irradiation. We discovered that imparting a steel sheet with tensions of at least 5.0 MPa in the rolling direction and a direction orthogonal to the rolling direction (which direction orthogonal to the rolling direction will be referred to as "transverse direction" hereinafter), respectively, effectively prevents magnetostrictive properties from deteriorating.

Tensions imparted by forsterite coating and tension coating are utilized as means for imparting a steel sheet with tensions.

Specifically, the aforementioned effect of preventing magnetostrictive properties of a steel sheet from deteriorating can be expected by setting the total tension in the rolling direction, imparted to the steel sheet by the forsterite coating and the tension coating, to be at least 5.0 MPa and also setting the total tension in the transverse direction imparted to the steel sheet by the forsterite coating and the tension coating to be at least 5.0 MPa. The total tension in the transverse direction is at least 5.0 MPa by primarily increasing tension imparted by the forsterite coating because tension coating generally does not make so much contribution to an increase in tension in the transverse direction.

When iron loss of a grain oriented electrical steel sheet itself as a product is evaluated, the increase in tension in the rolling direction suffices to improve iron loss properties of the steel sheet because magnetizing flux of the steel sheet is constituted of only rolling-direction components. However, when such a grain oriented electrical steel sheet as described above is assembled into a real transformer device, the magnetizing flux of the real transformer device has transverse-direction components, as well as the rolling-direction components. Accordingly, tension in the transverse direction, as well as tension in the rolling direction, affects iron loss of the real transformer device.

In view of this, the desired tension ratio is determined in terms of a ratio of the rolling-direction components with respect to the transverse-direction components of magnetizing flux. Specifically, a relationship shown in formula (1) is satisfied.

$$1.0 \leq A/B \leq 5.0 \quad (1)$$

A: the total tension in rolling direction imparted to the steel sheet by forsterite coating and tension coating B: the total tension in transverse direction imparted to the steel sheet by forsterite coating and tension coating In a case where an absolute value of tension imparted to a steel sheet is relatively low, iron loss still deteriorates even if the aforementioned relationship of formula (1) is satisfied. We studied preferable tension values in the rolling direction and the transverse direction, respectively, and found out that the total tension of forsterite coating and tension coating of 5.0 MPa or more suffices in the transverse direction, but the total tension of forsterite coating and tension coating of at least 10.0 MPa is required in the rolling direction.

The total tension of forsterite coating and tension coating is determined as follows.

The total tension of forsterite coating and tension coating of a steel sheet is determined by: cutting a sample (280 mm in rolling direction×30 mm in transverse direction) out when tension in the rolling direction is to be measured and a sample (280 mm in transverse direction×30 mm in rolling direction) out when tension in the transverse direction is to be measured, from the steel sheet; removing the forsterite coating and tension coating from one surface of each of the samples; measuring the magnitude of deflection of the steel sheet before removal of forsterite coating and tension coating and the magnitude of deflection after removal of the forsterite coating and the tension coating, for each sample; and converting the difference between the two magnitudes of deflection thus obtained into coating tension (σ) according to conversion formula (2) below. The coating tension determined by this method represents tension imparted to a sample surface from which forsterite coating and tension coating have not been removed. Considering that tension is imparted to respective surfaces of each sample, coating tension of the steel sheet was actually measured by: preparing two samples for each (rolling/transverse) direction; determining coating tension in each direction per one surface, for each of the samples, according to the aforementioned method; and calculating the average of the coating tension values of the two samples and regarding the average as the corresponding coating tension of the steel sheet.

$$\sigma = Ed \cdot (a_2 - a_1)/t^2 \quad (2)$$

σ: coating tension (MPa)

E: Young's modulus of a steel sheet=143 (GPa)

l: measured length of deflection (mm)

$a_1$: magnitude of deflection before removal of coatings (mm)

$a_2$: magnitude of deflection after removal of coatings (mm)

d: thickness of the steel sheet (mm)

Next, manufacturing conditions of the grain oriented electrical steel sheet will be described in detail.

The type of chemical composition of a slab for a grain oriented electrical steel sheet is not particularly restricted as long as the chemical composition allows secondary recrystallization to proceed and any known composition of a grain oriented electrical steel sheet can be employed without a problem.

The chemical composition may contain appropriate amounts of Al and N in a case where an inhibitor, e.g. AlN-based inhibitor, is utilized or appropriate amounts of Mn and Se and/or S in a case where MnS.MnSe-based inhibitor is utilized. Both AlN-based inhibitor and MnS-.MnSe-based inhibitor may be used in combination, of course. When inhibitors are used as described above, contents of Al, N, S and Se are preferably Al: 0.01 mass % to 0.065 mass %, N: 0.005 mass % to 0.012 mass %, S: 0.005 mass % to 0.03 mass %, and Se: 0.005 mass % to 0.03 mass %, respectively.

Our methods are also applicable to a grain oriented electrical steel sheet without using any inhibitor, having restricted Al, N, S, Se contents.

In the case of a grain oriented electrical steel sheet manufactured by inhibitorless process as described above, contents of Al, N, S and Se are preferably suppressed to Al: 100 mass ppm or less, N: 50 mass ppm or less, S: 50 mass ppm or less, and Se: 50 mass ppm or less, respectively.

Preferable basic components and other components to be optionally added of a slab for the grain oriented electrical steel sheet will be described in detail below.

C: 0.08 mass % or less

Carbon is added to improve the microstructure of a hot rolled steel sheet. The carbon content in the slab is preferably 0.08 mass % or less because a carbon content exceeding 0.08 mass % increases the burden of reducing carbon content to 50 mass ppm at which magnetic aging is reliably prevented during the manufacturing process. The lower limit of carbon content in the slab need not be particularly set because secondary recrystallization is possible in a material not containing carbon.

Si: 2.0 mass % to 8.0 mass %

Silicon is an element which effectively increases electrical resistance of steel to improve iron loss properties thereof. Silicon content in the slab equal to or higher than 2.0 mass % ensures a particularly good effect of reducing iron loss. On the other hand, Si content in the slab equal to or lower than 8.0 mass % ensures particularly excellent formability of steel and magnetic flux density of a resulting steel sheet. Accordingly, Si content in the slab is preferably in the range of 2.0 mass % to 8.0 mass %.

Mn: 0.005 mass % to 1.0 mass %

Manganese is an element which advantageously achieves good hot-formability of a steel sheet. A manganese content in the slab less than 0.005 mass % cannot cause the good effect of Mn addition sufficiently. A manganese content in the slab equal to or lower than 1.0 mass % ensures a particularly good magnetic flux density of a product steel sheet. Accordingly, the Mn content in the slab is preferably 0.005 mass % to 1.0 mass %.

Further, the slab for the grain oriented electrical steel sheet may contain the following elements as magnetic properties improving components in addition to the basic components described above.

At least one element selected from Ni: 0.03 mass % to 1.50 mass %. Sn: 0.01 mass % to 1.50 mass %, Sb: 0.005 mass % to 1.50 mass %, Cu: 0.03 mass % to 3.0 mass %, P: 0.03 mass % to 0.50 mass %, Mo: 0.005 mass % to 0.10 mass %, and Cr: 0.03 mass % to 1.50 mass %.

Nickel is a useful element in terms of further improving texture of a hot rolled steel sheet and thus magnetic properties of a resulting steel sheet. Nickel content in the slab less than 0.03 mass % cannot cause this magnetic properties-improving effect by Ni sufficiently. Nickel content in the slab equal to or lower than 1.5 mass % ensures stability in secondary recrystallization to improve magnetic properties of a resulting steel sheet. Accordingly, the Ni content in the slab is preferably 0.03 mass % to 1.5 mass %.

Sn, Sb, Cu, P, Mo and Cr are useful elements, respectively, in terms of further improving magnetic properties of the steel sheet. Contents of these elements lower than the respective lower limits described above result in an insufficient magnetic properties-improving effect. Contents of these elements equal to or lower than the respective upper limits described above ensure the optimum growth of secondary recrystallized grains. Accordingly, it is preferable that the slab contains at least one of Sn, Sb, Cu, P, Mo and Cr within the respective ranges thereof specified above.

The balance other than the aforementioned components of the slab is Fe and incidental impurities incidentally mixed into steel during the manufacturing process.

The slab having the aforementioned chemical composition is then either heated and hot rolled according to the conventional method or hot rolled without being heated immediately after casting. In a case of a thin slab or thin bar (such a thin slab or thin bar is regarded as a kind of slab), the thin slab or thin bar may be either directly hot rolled or skip hot rolling to proceed to the subsequent processes.

A hot rolled steel sheet thus obtained is then optionally subjected to hot-band annealing. The primary object of hot-band annealing is to eliminate band texture generated in hot rolling to make the grain size of the primary recrystallized texture even, thereby allowing Goss texture to further grow during secondary recrystallization annealing so that magnetic properties of the steel sheet improve. The temperature in the hot-band annealing is preferably 800° C. to 1100° C. in terms of ensuring advanced growth of Goss texture in a product steel sheet. A hot-band annealing temperature lower than 800° C. results in the retention of the band texture derived from hot rolling, thereby making it difficult to realize a uniform grain size of primary recrystallization texture and thus failing to improve secondary recrystallization as desired. On the other hand, the hot-band annealing temperature exceeding 1100° C. excessively coarsens grains after hot-band annealing, thereby making it difficult to realize uniform grain size of primary recrystallization texture.

The steel sheet, after the optional hot-band annealing, is subjected to either one cold rolling operation or at least two cold rolling operations with intermediate annealing therebetween. The steel sheet is then subjected to recrystallization annealing, coating of annealing separator, and final annealing for secondary recrystallization and formation of forsterite coating.

The annealing separator is mainly composed of MgO. "The annealing separator is mainly composed of MgO" means that the annealing separator may further contain known annealing separator components and property-improving components other than MgO unless presence of such other components adversely affects formation of a forsterite coating.

Shape correction is effectively carried out by flattening annealing after the final annealing. A surface of each steel sheet is provided with insulating coating either before or after the flattening annealing. The insulating coating is a coating capable of imparting a steel sheet with tension to reduce iron loss (which coating will be referred to as "tension coating" hereinafter). Examples of tension coating include inorganic coating containing silica, ceramic coating formed by physical deposition, chemical deposition, and the like. The tension coating is, however, not restricted to these examples and any known tension coating can be used.

The conditions in the aforementioned processes may be set according to the known prior art. The final annealing, for example, is generally carried out at temperature of 1100° C. to 1250° C. for a period of 1 hour to 20 hours.

What is most important is to adequately adjust tension in the rolling direction and tension in the transverse direction to be imparted to a steel sheet, respectively. Tension in the rolling direction can be controlled by adjusting coating weight of tension coating. Tension coating is generally formed by coating a steel sheet stretched in the rolling direction in a baking oven, with coating solution, and baking the steel sheet thus coated. That is, a coating material is baked on a steel sheet in a state where the steel sheet is stretched in the rolling direction and thermally expanded.

When the steel sheet thus provided with a coating by baking is released from the stretched state and cooled, the steel sheet shrinks more than the coating material does, as a result of shrinkage of the steel sheet due to release from the stretched state and difference in coefficient of thermal expansion between the steel sheet and the coating material, whereby there arises a state where the coating material stretches the steel sheet and thus the steel sheet is imparted with tension.

On the other hand, the steel sheet is not stretched in the transverse direction in the baking oven and thus the steel sheet is rather in a state where it is compressed in the transverse direction due to being stretched in the rolling direction. Such a compressed state cancels out elongation of the steel sheet in the transverse direction caused by thermal expansion. It is therefore difficult to increase, by tension coating, tension imparted in the transverse direction.

In view of the situation described above, we specified manufacturing conditions (a), (b) and (c) below to be controlled to enhance tension in the transverse direction exerted by the forsterite coating.

Specifically:

(a) coating weight of the annealing separator is 10.0 g/m$^2$ or more;

(b) coiling tension at which the steel sheet is coiled after being coated with the annealing separator is 30 N/mm$^2$ to 150 N/mm$^2$; and (c) the average cooling rate in cooling process of the final annealing down to 700° C. is 50° C./hour or less.

A steel sheet which is in a coiled state during the final annealing, tends to experience significantly uneven temperature distribution in the cooling process of the final annealing. As a result, the magnitude of thermal expansion of the steel sheet varies depending on portions thereof, whereby the steel sheet is imparted with stresses in various directions resulting from the uneven temperature distribution. Due to this, in a case where relatively strong coiling tension is exerted on the rolls of the coiled steel sheet and thus the coiled steel sheet has little gap between the rolls, forsterite coating is subjected to relatively strong stress and possibly damaged.

It is effective, to lessen such damage to forsterite coating as described above, to reduce stress generated in the steel sheet by providing some space between the rolls of the coiled steel sheet and reduce difference in temperature within the coiled steel sheet by decreasing cooling rate in the final annealing.

Reasons for why damage to the forsterite coating is reduced by controllably achieving manufacturing conditions (a)-(c) above will be described hereinafter.

Annealing separator releases moisture, $CO_2$ and the like during annealing, thereby decreasing the volume thereof as compared with that prior to annealing. A decrease in volume is synonymous with formation of a gap. The presence of annealing separator is therefore effective in mitigating stresses exerted on the coiled steel sheet. The coating weight of annealing separator is specified to 10.0 g/m$^2$ or more in this regard because too low coating weight of annealing separator results in insufficient formation of gaps. Coating weight of annealing separator is preferably 20.0 g/m$^2$ or less because too high coating weight of annealing separator ends up with a plateau in the gap-forming effect. "Coating weight of annealing separator" represents the total coating weight of annealing separator on respective surfaces of a steel sheet.

Gaps between the rolls of the coiled steel sheet increase and stresses generated in the coiled steel sheet are reduced when the steel sheet is coiled at relatively low coiling tension, as compared with when the steel sheet is coiled at relatively high coiling tension. However, too low coiling tension results in collapse of the coil, which is a problem. Accordingly, coiling tension exerted on the steel sheet in coiling thereof is 30 N/mm$^2$ to 150 N/mm$^2$ so that stresses generated due to uneven temperature distribution in cooling process of the final annealing are reliably mitigated and the coiled steel sheet is reliably prevented from collapsing.

Further, decreasing the cooling rate in the final annealing reduces difference in temperature within the coiled steel sheet and thus mitigates stresses in the coiled steel sheet. However, too low a cooling rate is not preferable in terms of production efficiency, although the lower cooling rate is better in terms of stress mitigation. The cooling rate is therefore preferably at least 5° C./hour. The acceptable upper limit of the cooling rate may be as high as 50° C./hour because controls of coating weight of annealing separator and coiling tension in the coiling operation are carried out as described above in combination with control of cooling rate in the final annealing.

In summary, stresses are mitigated and thus tension of forsterite coating in the transverse direction can be enhanced by controlling the coating weight of the annealing separator, coiling tension at which a steel sheet is coiled, and cooling rate in the final annealing.

The grain oriented electrical steel sheet is subjected to magnetic domain refinement through irradiation by laser or electron beam on a surface thereof at a stage either after the aforementioned final annealing or application of tension coating. In this connection, improvement of iron loss properties achieved by the thermal strain-imparting effect of laser/electron beam irradiation is prevented from being cancelled out by deterioration of iron loss properties due to degradation of the forsterite coating and thus a sufficient magnetic domain refinement effect can be obtained, by controlling the total tension in the rolling direction imparted to the steel sheet by forsterite coating and tension coating and the total tension in the transverse direction imparted to the steel sheet by the forsterite coating and tension coating, as described above.

Either continuous-wave laser or pulse laser can be used as a source of a laser to be irradiated. Types of laser, e.g. YAG laser, $CO_2$ laser and the like, are not restricted, either. A laser-irradiated mark may take on either a linear or spot-like shape. The laser-irradiated mark is preferably inclined by 90° to 45° with respect to the rolling direction of a steel sheet.

Green laser marking, which has been increasingly used recently, is particularly preferable in terms of irradiation precision.

The laser output of a green laser marking is preferably 5 J/m to 100 J/m when expressed as a quantity of heat per unit length. The spot diameter of the laser beam is preferably 0.1 mm to 0.5 mm and the repetition interval in the rolling direction is preferably 1 mm to 20 mm.

Depth of plastic strain imparted to a steel sheet is preferably 10 μm to 40 μm.

In a case where an electron beam is irradiated, it is effective to carry out irradiation under conditions of acceleration voltage: 10 kV to 200 kV, electric current: 0.1 mA to 100 mA, and beam diameter: 0.01 mm to 0.5 mm such that a laser-irradiated mark takes on either a spot-like or linear shape. Irradiation is to be carried out in a direction crossing the rolling direction, preferably in a direction inclined by 45° to 90° with respect to the rolling direction, with intervals of 1 mm to 20 mm or so between laser-irradiated marks. Depth of plastic strain imparted to a steel sheet is preferably in the range of 10 μm to 40 μm.

The conventionally known method for manufacturing a grain oriented electrical steel sheet involving magnetic domain refinement using laser or electron beam can be applied to other features of the present invention than the aforementioned processes and manufacturing conditions.

Examples

[Experiment 1]

A steel slab having a chemical composition as shown in Table 1 was prepared by continuous casting. The steel slab was heated to 1450° C. and hot-rolled to sheet thickness: 2.0 mm to obtain a hot rolled steel sheet. The hot rolled steel sheet was subjected to hot-band annealing at 1050° C. for 120 seconds. The steel sheet was then subjected to first cold rolling to the intermediate sheet thickness: 0.60 mm, intermediate annealing under the conditions of degree of oxidation ($PH_2O/PH_2$)=0.35, temperature: 950° C., and retention time: 100 seconds, pickling with hydrochloric acid to remove subscales on steel sheet surfaces, and second cold rolling to sheet thickness: 0.23 mm in this order to obtain a cold rolled steel sheet.

TABLE 1

| Chemical composition | | | | | | | | |
|---|---|---|---|---|---|---|---|---|
| C (mass ppm) | Si (mass %) | Mn (mass %) | Ni (mass %) | O (mass ppm) | N (mass ppm) | Al (mass ppm) | Se (mass ppm) | S (mass ppm) |
| 700 | 3.25 | 0.03 | 0.1 | 20 | 80 | 250 | tr | 15 |

Next, the cold rolled steel sheet thus obtained was subjected to decarburizing annealing under the conditions of degree of oxidation ($PH_2O/PH_2$)=0.45, soaking temperature: 830° C., and retention time: 300 seconds, and then coated with annealing separator mainly constituted of MgO. Coating weight of the annealing separator and coiling tension at which the steel sheet was coiled after being coated with the annealing separator were changed, respectively, as shown in Table 2. The steel sheet was then subjected to the final annealing for secondary recrystallization and purification at 1230° C. for 5 hours.

The average cooling rate in cooling process of the final annealing in the temperature range of 700° C. or higher was also changed (as shown in Table 2). The steel sheet thus subjected to the final annealing was then provided with a tension coating composed of 50% colloidal silica and magnesium phosphate. Tension in the rolling direction, imparted to the steel sheet, was adjusted by changing the coating weight of the tension coating. Finally, the steel sheet was subjected to magnetic domain refinement by irradiating the steel sheet with a pulse laser linearly in a direction orthogonal to the rolling direction with laser-irradiation width: 0.2 mm and laser-irradiation interval: 10 mm, whereby a steel sheet product sample was obtained. Magnetic properties and tension imparted by the coatings of each of the steel sheet product samples thus obtained were evaluated. Each of the steel sheet product samples was then sheared into specimens having bevel edges and assembled into a 500 kVA three-phase transformer and iron loss and noise of the transformer were measured, respectively, in a state where the transformer was magnetized at 50 Hz, 1.7 T.

The measurement results of iron loss and noise thus obtained are shown in Table 2.

TABLE 2

| No. | Coating weight of annealing separator ($g/m^2$) | Coiling tension in coiling after coating of annealing separator ($N/mm^2$) | Cooling rate down to 700° C. (° C./h) | Tension imparted to steel sheet: Tension (A) in rolling direction (MPa) | Tension imparted to steel sheet: Tension (B) in transverse direction (MPa) | A/B | Steel sheet product $W_{17/50}$ (W/kg) | Transformer: $W_{17/50}$ (W/kg) | Transformer: Noise (dBA) | Building factor (iron loss of transformer/iron loss of steel sheet product) | Other features | Note |
|---|---|---|---|---|---|---|---|---|---|---|---|---|
| 1 | 13 | 25 | 25 | — | — | — | — | — | — | | Coil collapsed (product failures) | Comp. Example |
| 2 | 5 | 50 | 30 | 15 | 2.7 | 5.56 | 0.67 | 0.92 | 61 | 1.37 | — | Comp. Example |
| 3 | 8 | 50 | 30 | 15 | 4.0 | 3.75 | 0.67 | 0.82 | 61 | 1.22 | — | Comp. Example |
| 4 | 11 | 50 | 30 | 15 | 7.5 | 2.0 | 0.67 | 0.81 | 54 | 1.21 | — | Example |
| 5 | 11 | 50 | 30 | 9 | 8.0 | 1.125 | 0.72 | 0.88 | 55 | 1.22 | — | Comp. Example |
| 6 | 13 | 50 | 30 | 15 | 5.5 | 2.73 | 0.67 | 0.81 | 54 | 1.21 | — | Example |
| 7 | 12 | 80 | 100 | 16 | 1.8 | 8.89 | 0.67 | 0.93 | 62 | 1.39 | — | Comp. Example |
| 8 | 12 | 80 | 60 | 16 | 2.7 | 5.93 | 0.67 | 0.94 | 61 | 1.40 | — | Comp. Example |
| 9 | 12 | 80 | 40 | 7 | 8.0 | 0.875 | 0.73 | 0.99 | 54 | 1.35 | — | Comp. Example |
| 10 | 12 | 80 | 40 | 16 | 6.5 | 2.46 | 0.66 | 0.80 | 53 | 1.21 | — | Example |
| 11 | 12 | 80 | 20 | 16 | 6.0 | 2.67 | 0.66 | 0.80 | 53 | 1.21 | — | Example |
| 12 | 12 | 80 | 20 | 32 | 6.0 | 5.33 | 0.64 | 0.88 | 61 | 1.38 | — | Comp. Example |
| 13 | 9 | 80 | 20 | 16 | 4.2 | 3.81 | 0.67 | 0.83 | 62 | 1.24 | — | Comp. Example |
| 14 | 12 | 80 | 3 | 16 | 6.5 | 2.46 | 0.66 | 0.80 | 53 | 1.21 | (Low production efficiency) | Example |
| 15 | 15 | 120 | 50 | 15 | 5.5 | 2.73 | 0.67 | 0.82 | 55 | 1.22 | — | Example |
| 16 | 15 | 170 | 30 | 16 | 3.0 | 5.33 | 0.67 | 0.94 | 61 | 1.40 | — | Comp. Example |
| 17 | 8 | 170 | 30 | 16 | 2.4 | 6.67 | 0.67 | 0.97 | 66 | 1.45 | — | Comp. Example |
| 18 | 15 | 170 | 100 | 16 | 1.8 | 8.89 | 0.67 | 0.97 | 66 | 1.45 | — | Comp. Example |
| 19 | 12 | 250 | 30 | 15 | 1.8 | 8.3 | 0.67 | 0.95 | 64 | 1.42 | — | Comp. Example |
| 20 | 8 | 300 | 60 | 15 | 1.2 | 12.5 | 0.67 | 1.03 | 68 | 1.54 | — | Comp. Example |

"Example" represents an Example according to the present invention.

It is understood from the results shown in Table 2 that use of a grain oriented electrical steel sheet subjected to magnetic domain refinement by laser and having tensions in our range successfully reduces noise and suppresses deterioration of the "building factor" of a resulting real transformer device, thereby allowing the real transformer device to exhibit extremely good iron loss properties. In contrast, a real transformer device using a grain oriented electrical steel sheet outside our range fails to reduce both noise and iron loss in a compatible manner.

[Experiment 2]

The manufacturing conditions were the same as those in Experiment 1 up to the stage of providing tension coating on a steel sheet. The coating weight of the annealing separator and the coiling tension at which the steel sheet was coiled after being coated with the annealing separator of Experiment 2 are shown, respectively, in Table 3.

Each of the steel sheets thus obtained was subjected to magnetic domain refinement by irradiating the steel sheet with an electron beam linearly in a direction orthogonal to the rolling direction with beam-irradiation width: 0.18 mm and beam-irradiation interval: 5.0 mm, whereby a steel sheet product sample was obtained. Magnetic properties and tension imparted by the coatings, of each of the steel sheet product samples thus obtained, were evaluated. Each of the steel sheet product samples was then obliquely sheared and assembled into a 500 kVA three-phase transformer and iron loss and noise of the transformer were measured, respectively, in a state where the transformer was magnetized at 50 Hz, 1.7 T.

The measurement results of iron loss and noise thus obtained are shown in Table 3.

TABLE 3

| No. | Coating weight of annealing separator (g/m²) | Coiling tension in coiling after coating of annealing separator (N/mm²) | Cooling rate down to 700° C. (° C./h) | Tension imparted to steel sheet: Tension (A) in rolling direction (MPa) | Tension (B) in transverse direction (MPa) | A/B | Steel sheet product $W_{17/50}$ (W/kg) | Transformer $W_{17/50}$ (W/kg) | Transformer Noise (dBA) | Building factor (iron loss of transformer/iron loss of steel sheet product) | Other features | Note |
|---|---|---|---|---|---|---|---|---|---|---|---|---|
| 1 | 13 | 25 | 25 | — | — | — | — | — | — | — | Coil collapsed (product failures) | Comp. Example |
| 2 | 5 | 50 | 30 | 14 | 2.5 | 5.60 | 0.68 | 0.91 | 60 | 1.34 | — | Comp. Example |
| 3 | 8 | 50 | 30 | 14 | 3.8 | 3.68 | 0.68 | 0.81 | 60 | 1.19 | — | Comp. Example |
| 4 | 11 | 50 | 30 | 14 | 7.3 | 1.92 | 0.68 | 0.80 | 53 | 1.18 | — | Example |
| 5 | 11 | 50 | 30 | 8 | 7.0 | 1.14 | 0.73 | 0.87 | 54 | 1.19 | — | Comp. Example |
| 6 | 13 | 50 | 30 | 14 | 5.2 | 2.69 | 0.68 | 0.80 | 53 | 1.18 | — | Example |
| 7 | 12 | 80 | 100 | 15 | 1.6 | 9.38 | 0.68 | 0.92 | 61 | 1.35 | — | Comp. Example |
| 8 | 12 | 80 | 60 | 15 | 2.5 | 6.00 | 0.68 | 0.93 | 60 | 1.37 | — | Comp. Example |
| 9 | 12 | 80 | 40 | 6 | 9.0 | 0.67 | 0.74 | 0.98 | 53 | 1.32 | — | Comp. Example |
| 10 | 12 | 80 | 40 | 15 | 6.3 | 2.38 | 0.67 | 0.79 | 52 | 1.18 | — | Example |
| 11 | 12 | 80 | 20 | 15 | 5.8 | 2.59 | 0.67 | 0.79 | 52 | 1.18 | — | Example |
| 12 | 12 | 80 | 20 | 31 | 5.8 | 5.34 | 0.65 | 0.87 | 60 | 1.34 | — | Comp. Example |
| 13 | 9 | 80 | 20 | 15 | 4.0 | 3.75 | 0.68 | 0.82 | 61 | 1.21 | — | Comp. Example |
| 14 | 12 | 80 | 3 | 15 | 6.3 | 2.38 | 0.67 | 0.79 | 52 | 1.18 | (Low production efficiency) | Example |
| 15 | 15 | 120 | 50 | 14 | 5.4 | 2.59 | 0.68 | 0.81 | 54 | 1.19 | — | Example |
| 16 | 15 | 170 | 30 | 15 | 2.8 | 5.36 | 0.68 | 0.93 | 60 | 1.37 | — | Comp. Example |
| 17 | 8 | 170 | 30 | 15 | 2.2 | 6.82 | 0.68 | 0.96 | 65 | 1.41 | — | Comp. Example |
| 18 | 15 | 170 | 100 | 15 | 1.6 | 9.38 | 0.68 | 0.96 | 65 | 1.41 | — | Comp. Example |
| 19 | 12 | 250 | 30 | 14 | 1.6 | 8.75 | 0.68 | 0.94 | 63 | 1.38 | — | Comp. Example |
| 20 | 8 | 300 | 60 | 14 | 1.1 | 12.73 | 0.68 | 1.02 | 67 | 1.50 | — | Comp. Example |

"Example" represents an Example according to the present invention.

It is understood from the results shown in Table 3 that use of a grain oriented electrical steel sheet subjected to magnetic domain refinement by electron beam and having tensions in our range successfully reduces noise and suppresses deterioration of the "building factor" of a resulting real transformer device, thereby allowing the real transformer device to exhibit extremely good iron loss properties. In contrast, a real transformer device using a grain oriented electrical steel sheet outside our range fails to reduce both noise and iron loss in a compatible manner.

INDUSTRIAL APPLICABILITY

It is possible to effectively maintain an excellent effect of reducing iron loss through magnetic domain refinement using laser/electron beam demonstrated by a steel sheet, in a resulting real transformer device, as well, whereby a grain oriented electrical steel sheet exhibiting, when assembled into a real transformer device, excellent low-noise properties and low-iron loss properties can be obtained.

The invention claimed is:

1. A grain oriented electrical steel sheet having a forsterite coating and tension coating on a surface thereof and having plastic strain extending in a direction inclined by 45° to 90° with respect to the rolling direction, wherein:

the forsterite coating is formed by coating a surface of the steel sheet with 10.0 g/m² to 20.0 g/m² of annealing separator;

total tension in a rolling direction imparted to the steel sheet by the forsterite coating and the tension coating is equal to or higher than 15 MPa, total tension in a direction orthogonal to the rolling direction imparted to the steel sheet by the forsterite coating and the tension coating is equal to or higher than 5.0 MPa; and the total tension in the rolling direction and the total tension in the direction orthogonal to the rolling direction satisfy $$1.0 \leq A/B \leq 5.0$$

A: the total tension in rolling direction imparted to the steel sheet by forsterite coating and tension coating, and B: the total tension in a direction orthogonal to the rolling direction imparted to the steel sheet by forsterite coating and tension coating.

2. A method of manufacturing the grain oriented electrical steel sheet of claim 1, comprising:

rolling a slab for a grain oriented electrical steel sheet to obtain a steel sheet having final sheet thickness;

subjecting the steel sheet to decarburizing annealing;

then coating a surface of the steel sheet with annealing separator mainly composed of MgO;

subjecting the steel sheet thus coated to final annealing;

providing a tension coating to the steel sheet; and subjecting the steel sheet to magnetic domain refinement by laser irradiation after either the final annealing or provision of the tension coating, wherein (1) coating weight of the anneal separator is set from 10.0 $g/m^2$ to 20.0 $g/m^2$;

(2) coiling tension at which the steel sheet is coiled after being coated with the annealing separator is set to 30 $N/mm^2$ to 150 $N/mm^2$; and (3) controlling the average cooling rate in cooling process of the final annealing down to 700° C. to 50° C./hour or less.

3. The method of claim 2, further comprising subjecting the slab to the hot rolling, optionally, hot-band annealing, and either one cold rolling operation or at least two cold rolling operations with intermediate annealing therebetween to obtain a steel sheet having the final sheet thickness.

4. A method of manufacturing the grain oriented electrical steel sheet of claim 1, comprising:

rolling a slab for a grain oriented electrical steel sheet to obtain a steel sheet having final sheet thickness;

subjecting the steel sheet to decarburizing annealing;

then coating a surface of the steel sheet with annealing separator mainly composed of MgO;

subjecting the steel sheet thus coated to final annealing;

providing a tension coating to the steel sheet; and subjecting the steel sheet to magnetic domain refinement by electron beam irradiation after either the final annealing or provision of the tension coating, wherein (1) coating weight of the anneal separator is set from 10.0 $g/m^2$ to 20.0 $g/m^2$;

(2) coiling tension at which the steel sheet is coiled after being coated with the annealing separator is set to 30 $N/mm^2$ to 150 $N/mm^2$; and (3) controlling the average cooling rate in cooling process of the final annealing down to 700° C. to 50° C./hour or less.

5. The method of claim 4, further comprising subjecting the slab to the hot rolling, optionally, hot-band annealing, and either one cold rolling operation or at least two cold rolling operations with intermediate annealing therebetween to obtain a steel sheet having the final sheet thickness.

* * * * *